US008106763B2

(12) United States Patent
Otterbach et al.

(10) Patent No.: US 8,106,763 B2
(45) Date of Patent: Jan. 31, 2012

(54) SENSOR SYSTEM AND METHOD FOR SEQUENTIAL TRANSMISSION OF DATA

(75) Inventors: Jens Otterbach, Wenden (DE); Christian Ohl, Pfullingen (DE); Oliver Kohn, Reutlingen (DE); Jochen Schomacker, Reutlingen (DE); Michael Ulmer, Moessingen (DE)

(73) Assignee: Robert Bosch GmbH, Stuttgart (DE)

( * ) Notice: Subject to any disclaimer, the term of this patent is extended or adjusted under 35 U.S.C. 154(b) by 541 days.

(21) Appl. No.: 10/571,730

(22) PCT Filed: Jul. 22, 2004

(86) PCT No.: PCT/DE2004/001605

§ 371 (c)(1),
(2), (4) Date: Mar. 16, 2007

(87) PCT Pub. No.: WO2005/027072

PCT Pub. Date: Mar. 24, 2005

(65) Prior Publication Data

US 2007/0229306 A1 Oct. 4, 2007

(30) Foreign Application Priority Data

Sep. 15, 2003 (DE) ..... 103 42 625

(51) Int. Cl.
*G08B 29/00* (2006.01)

(52) U.S. Cl. ..... 340/512; 340/505; 340/509; 702/62; 702/188

(58) Field of Classification Search ..... 702/62
See application file for complete search history.

(56) References Cited

U.S. PATENT DOCUMENTS

| | | | | | |
|---|---|---|---|---|---|
| 4,203,096 | A | * | 5/1980 | Farley et al. | 340/538 |
| 4,464,739 | A | * | 8/1984 | Moorcroft | 367/130 |
| 4,540,890 | A | * | 9/1985 | Gangemi et al. | 307/40 |
| 4,555,695 | A | * | 11/1985 | Machida et al. | 340/538 |
| 4,568,919 | A | * | 2/1986 | Muggli et al. | 340/518 |
| 4,754,262 | A | * | 6/1988 | Hackett et al. | 340/525 |
| 4,788,527 | A | * | 11/1988 | Johansson | 340/10.2 |
| 5,252,967 | A | * | 10/1993 | Brennan et al. | 340/870.02 |
| 2003/0076221 | A1 | * | 4/2003 | Akiyama et al. | 340/310.01 |

FOREIGN PATENT DOCUMENTS

| | | |
|---|---|---|
| DE | 33 30 904 | 3/1985 |
| DE | 198 22 146 | 12/1998 |
| DE | 101 14 504 | 10/2002 |
| EP | 0 583 716 | 2/1994 |
| JP | 52-090055 | 7/1977 |
| JP | 55-060362 | 5/1980 |
| JP | 60-160239 | 8/1985 |
| JP | 10-32694 | 2/1989 |
| JP | 5-176406 | 7/1993 |
| JP | 2003-032159 | 1/2003 |

* cited by examiner

*Primary Examiner* — Jonathan Teixeira Moffat
(74) *Attorney, Agent, or Firm* — Kenyon & Kenyon LLP

(57) ABSTRACT

A sensor has a transmitter module for transferring data via a line, the sensor receiving power via the line. At a point in time in which the sensor receives a first power level, it transmits the data for a first time interval. A second sensor which is connected to the line in parallel to the first sensor then transmits its data for a second time interval after the first time interval. A timing sequence control system in the two sensors which is triggered by the point in time of reception of the power ensures the subsequent transmission by the first and second sensor.

14 Claims, 2 Drawing Sheets

SENSOR SYSTEM AND METHOD FOR SEQUENTIAL TRANSMISSION OF DATA

RELATED APPLICATION INFORMATION

This application is a National Stage Application of PCT International Application of PCT/DE2004/001605, filed Jul. 22, 2004, and which claims priority to German Patent Application No DE 103 42 625.6, filed Sep. 15, 2003, each of which are incorporated herein by reference in its entirety.

BACKGROUND INFORMATION

A method for transferring data from at least one sensor to a control unit is described in German Patent Application No. DE 101 14 504, in which the sensor is connected to the control unit via a two-wire line and receives power for its operation via this two-wire line. The sensor then permanently transfers its measured data via the two-wire line using current modulation. After the power is received, the sensor transmits immediately, first transferring a sensor identification, a status identification and sensor values to the control unit as data.

SUMMARY OF THE INVENTION

The sensor according to the present invention has the advantage that it is now possible to connect a plurality of sensors in parallel to one line. In order to provide each sensor with a possibility of transmitting its data, this data is sent in successive time slots. The triggering event for transmitting is an increase of the power on the line to a first higher level by the control unit. The sensors detect this increase in power so that this point in time causes the timing sequence control system in the individual sensors to be triggered. Each timing sequence control system in each sensor tells the individual sensor when it may transmit. The timing sequence control systems are coordinated with one another so that it is impossible for the sensor data to overlap during transmission. The procedure ends when the last sensor has transmitted its data. It is possible for the first sensor to resend its data so that all sensors can transmit their data cyclically. However, it is also possible that after the data of the last sensor is transmitted, the control unit will return the power level to a zero level in order to increase the power level again and trigger the transmission of the sensors' data.

Crash sensors, precrash sensors, but also occupant position sensors, such as weight sensors or video sensors, may be considered as sensors. They may be connected to a common line but also to various lines so that one type of sensor is constantly connected to one line. The sensor of the present invention is configured very simply in order to make unidirectional data transfer from the sensor to a control unit possible without having to use bus technology. The transmission is entirely event-controlled and proceeds without elaborate bus protocol communications. This results in high reliability and a cost-effective and simple product. In particular, the sensors may be designed to be very simple with respect to their electronics. In particular, the present invention makes it possible for the sensors to be connected to the line in parallel.

All sensors are thus connected in parallel to an interface circuit. A specific time interval is assigned to each sensor, for example, by programming a parameter in the sensor. The line is normally configured as a two-wire line. However, it is also possible to configure it as a single-wire circuit. The feed of the first power level, i.e., connecting the voltage or changing a voltage level, provides the start signal for the transfer of data from the sensors to the control unit. The timing sequence control system in the sensors ensures that each sensor transmits its data only in the time interval assigned to it. The time intervals and the times of data transfer are designed to avoid overlapping.

It is advantageous in particular that a second power level is constantly supplied to the sensor, the second one being lower than the first power level, i.e., it does not give the signal to transmit. This second power level that is characterized by a second voltage ensures that the sensor is constantly in operation, i.e., the sensor is not reset when the first power level is switched on.

It is a further advantage that the sensors have means for detecting the voltage or the voltage change in order to detect the first or second power level.

DETAILED DESCRIPTION

In automotive engineering, crash sensors and sensors for detecting the position of occupants are connected by lines to a control unit which activates restraining means. It has become generally accepted that this communication is frequently unidirectional, i.e., from the sensors to the control unit but not vice versa. However, one sensor has a single line to the control unit and a second sensor has another line. This limits the number of sensors connectable to a control unit. The term line in this case describes a line having two wires; however, a single-wire line is also possible.

According to the present invention, a type of quasi-bus is implemented, the transmission of the sensors being time-controlled. The triggering event for the timing sequence control system is an increase of the power on the line, to which the sensors are connected in parallel. The first sensor then detects, as do all the other sensors, the increase to a first power level and thus the point in time is given which is critical for the timing sequence control system. Each sensor is then given a time slot assigned by its timing sequence control system for sending its data to the control unit. These time slots have already been programmed by the manufacturer in such a way that they do not overlap. The manufacturer thus provides coordination of the transmission slots.

Figure 1:
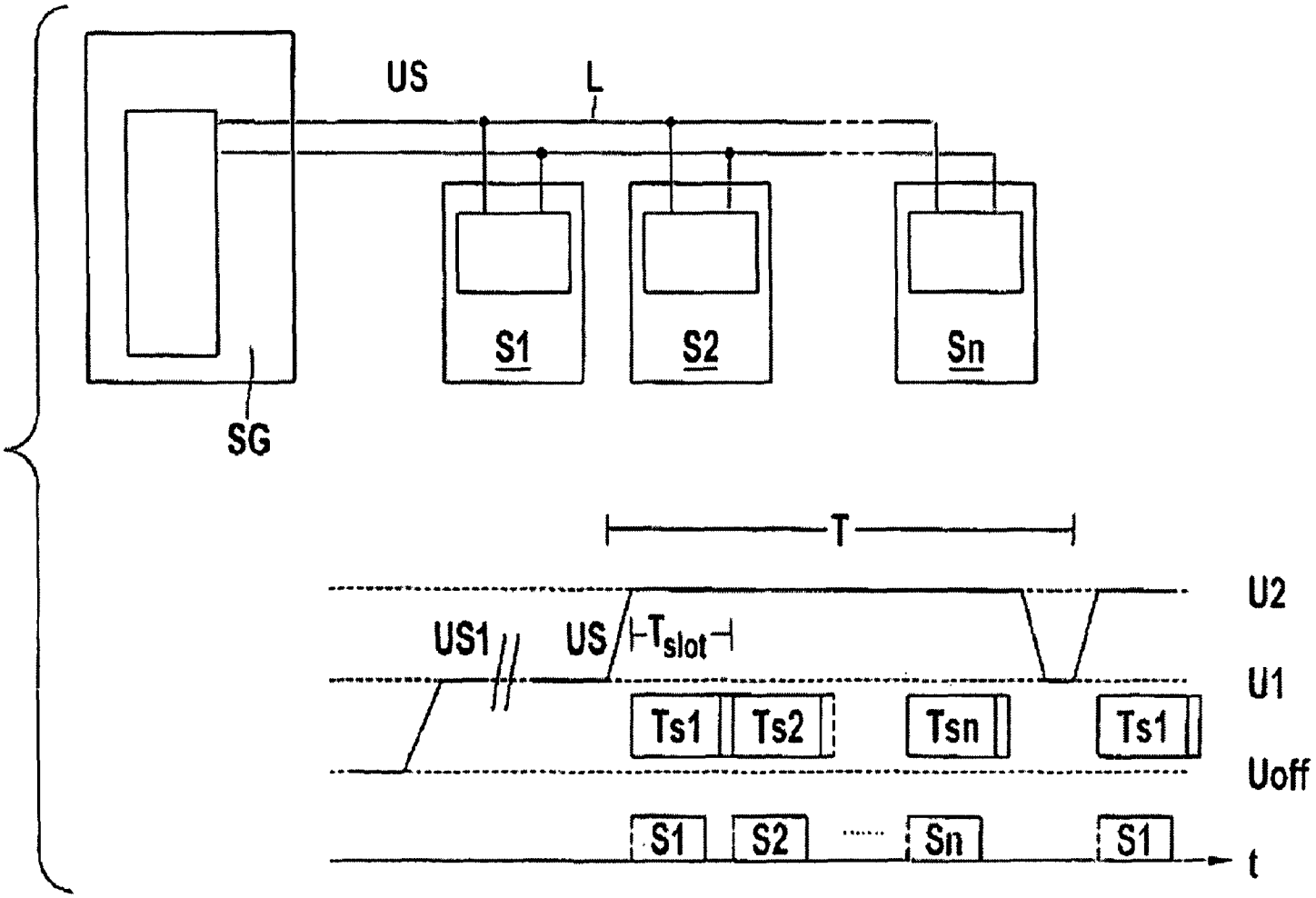
FIG. 1 shows a block diagram of the present invention.

FIG. 1 illustrates the present invention in a block diagram. Sensors S1, S2 to Sn are connected to a control unit SG in parallel to one another via a line L, which is designed as a two-wire line. Voltage level US is applied to line L. This voltage level US is impressed on line L by control unit SG. Control unit SG is thus used as a power source for sensors S1, S2 to Sn connected to line L. The control unit uses the power consumption to verify the number of sensors connected to line L. No power supply lines are provided for sensors S1, S2 to Sn nor is energy storage provided in sensors S1, S2 to Sn. The sole supply of power for sensors S1, S2 to SN is via line L. Sensors S1, S2 to Sn transfer data unidirectionally to control unit SG which has a receiver module for receiving these data. As a function of these data, control unit SG activates, for example, restraining means such as airbags or belt tensioners. To prevent collisions between the data of individual sensors S1, S2 to Sn on line L, a mechanism is provided which controls the transmission of individual sensors S1, S2 to Sn. According to the present invention, the variation of voltage US on line L initiates the transmission process while each of individual sensors S1, S2 to Sn has a timing sequence control system which is designed in such a way that it assigns a time slot for transmission to each of sensors S1, S2 to Sn, i.e., overlaps of these time slots are avoided. For that reason, timing sequence control system in individual sensors S1, S2 to Sn must already be set by the manufacturer in order to coordinate these time slots with one another. In this case, this means that sensor S1 first transmits its data in one time interval and sensor S2 then sends its data in a subsequent time interval. This is carried out until last sensor Sn has sent its data.

It is then possible for Sensor S1 to transmit its data in a predetermined time interval so that a cyclical loop is present for transmitting the sensor data.

However, it is also possible that after sensor Sn has transmitted its data, control unit SG reduces the voltage on line L to terminate the transmission. The event that triggers the transmission is the increase of voltage US. Voltage US may be increased abruptly or gradually. If voltage US exceeds a threshold value which is tested by individual sensors S1, S2 to Sn, the point in time is then set at which timing sequence control system starts. Voltage US represents a power level that is assigned to sensors S1, S2 to Sn. In the phase in which the voltage level that prompts the transmission of data is not maintained on line L, a rest phase voltage U1 is present which makes operation of the sensors possible without it being necessary for them to perform a reset when they are supposed to transmit again. As an alternative, it is also possible for voltage US to be raised above the threshold only briefly in order to trigger the event and then return to a lower voltage level because it is then no longer necessary to trigger the event. However, it may, as stated, be maintained at the increased voltage level for the entire transmission phase.

A timing diagram is also shown under the block diagram in FIG. 1. It is a voltage-time diagram that shows both voltage US and the transmission phase of the individual sensors. Initially, voltage level US is at voltage Uoff.

The voltage may be switched on and off by the control unit. As a result, it may be possible, for example, for the sensor to be reset. Normally, the sensor is switched on once by the control unit after the motor vehicle is started (voltage on US) and then stays on until the ignition is switched off again.

The voltage is then increased to value U1 which does not yet trigger the transmission of sensors S1, S2 to Sn but it supplies them with enough power without which they would have to perform a reset when they were supposed to transmit. Finally, voltage US is increased to value U2 for a predetermined time segment. In this time segment, individual sensors S1 to Sn transmit their data S1, S2 to Sn in time segments Ts1, Ts2 to Tsn. After this time segment, control unit SG again reduces voltage US to the value U1 and then increases it again to the value U2 so that the transmission cycle may then be restarted. As stated, alternatives are possible; specifically, it is possible to increase voltage US only briefly to voltage U2 in order to trigger the event, or voltage US may persist at voltage U2 and the sensors will send their data cyclically.

Figure 2:
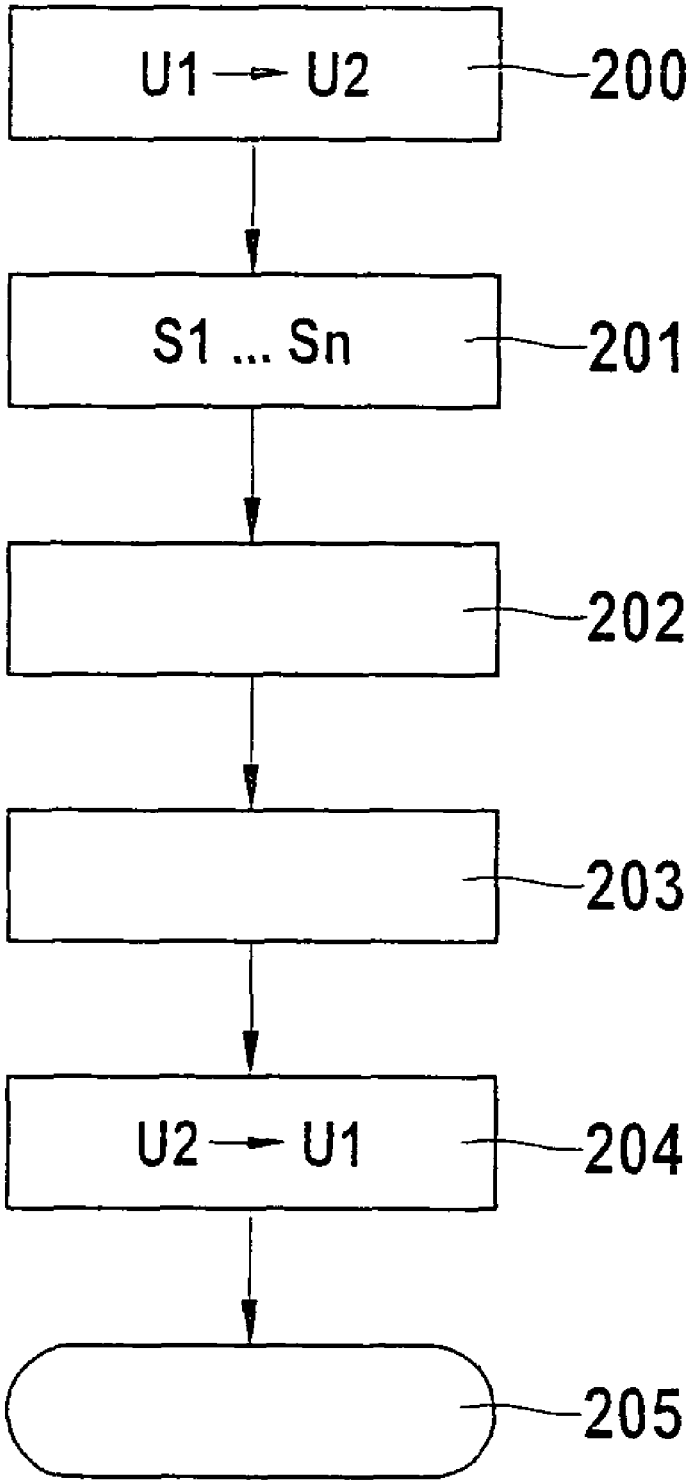
FIG. 2 shows a flow chart.

FIG. 2 elucidates the present invention in a flow chart. In step 200, voltage US is increased from the value U1 to the value U2 in order to trigger transmission by sensors S1, S2 to Sn. In step 201, sensors S1, S2 to Sn detect that the voltage has been increased. For this purpose, an absolute value detection or a voltage change (detection) may be considered. This increase triggers the start of the timing sequence control system in step 202. In step 203, individual sensors S1, S2 to Sn transmit the data in their assigned time slots. In step 204, control unit SG reduces the voltage of U2 to U1 after the last sensor has transmitted its data. The process ends in step 205. As shown above, there are several possibilities for carrying out this process cyclically or in a controlled manner by increasing and reducing voltage US on line L.

What is claimed is:

1. A sensor system comprising:

a first sensor powered by a line, the first sensor preprogrammed with a first time interval for transmitting data via the line;

a second sensor powered by the line in parallel with the first sensor, the second sensor preprogrammed with a second time interval for transmitting data via the line;

a first timing sequence control system included in the first sensor; and a second timing sequence control system included in the second sensor;

wherein, in response to each instance of receiving a first power level, the first timing sequence control system is triggered and, upon being triggered, controls the transmission of the first sensor so that the first sensor transmits data via the line for the first time interval, wherein, in response to each instance of receiving the first power level, the second timing sequence control system is triggered and, upon being triggered, controls the transmission of the second sensor so that the second sensor transmits data via the line for the second time interval after the first time interval, wherein, upon being triggered, the first and second timing sequence control systems control the transmission of the first and second sensors so that the first and second sensors each transmit data via the line at least once independent of any change in a power level received by the first and second timing sequence control systems, wherein the first and second timing sequence control systems receive the first power level throughout the first and second time intervals and wherein a second power level is constantly supplied from the line to the first and second sensors, wherein the second power level is lower than the first power level, and wherein the second power level ensures that the first and second sensors are constantly in operation.

2. The sensor system according to claim 1, wherein the first and second sensors are always supplied at least a second power level, the second power level being lower than the first power level.

3. The sensor system according to claim 1, wherein the first and second sensors detect the first power level via a voltage change.

4. The sensor system according to claim 1, wherein the first and second sensors are connected to a control unit via the line, data transmission during the time between the end of the first time interval and the end of the second time interval only being provided from the sensors to the control unit, and not from the control unit to the sensors.

5. The sensor system according to claim 1, wherein the first and second sensors are always supplied at least a second power level, the second power level being lower than the first power level, and wherein the first and second sensors are connected to a control unit via the line, data transmission during the time between the end of the first time interval and the end of the second time interval only being provided from the sensors to the control unit, and not from the control unit to the sensors.

6. The sensor system according to claim 1, wherein the first and second sensors are always supplied at least a second power level, the second power level being lower than the first power level, wherein the first and second sensors detect the first power level via a voltage change, and wherein the first and second sensors are connected to a control unit via the line, data transmission during the time between the end of the first time interval and the end of the second time interval only being provided from the sensors to the control unit, and not from the control unit to the sensors.

7. A method for sequential transmission of sensor data, comprising:

powering a first sensor by a line, the first sensor preprogrammed with a first time interval for transmitting data via the line; and powering a second sensor by the line in parallel with the first sensor, the second sensor preprogrammed with a second time interval for transmitting data via the line;

whereto a first timing sequence control system is included within the first sensor and a second timing sequence control system is included within the second sensor, wherein, in response to each instance of receiving a first power level, the first timing sequence control system is triggered and, upon being triggered, controls the transmission of the first sensor so that the first sensor transmits data via the line for the first time interval, wherein, in response to each instance of receiving the first power level, the second timing sequence control system is triggered and, upon being triggered, controls the transmission of the second sensor so that the second sensor transmits data via the line for the second time interval after the first time interval, wherein, upon being triggered, the first and second timing sequence control systems control the transmission of the first and second sensors so that the first and second sensors each transmit data via the line at least once independent of any change in a power level received by the first and second timing sequence control systems, wherein the first and second timing sequence control systems receive the first power level throughout the first and second time intervals and wherein a second power level is constantly supplied from the line to the first and second sensors, wherein the second power level is lower than the first power level, and wherein the second power level ensures that the first and second sensors are constantly in operation.

8. The method according to claim 7, wherein the first and second sensors are always supplied at least a second power level, the second power level being lower than the first power level.

9. The method according to claim 7, wherein the first and second sensors detect at least the first power level via a voltage change.

10. The method according to claim 7, wherein the first and second sensors are connected to a control unit via the line, data transmission during the time between the end of the first time interval and the end of the second time interval only being provided from the sensors to the control unit, and not from the control unit to the sensors.

11. The method according to claim 7, wherein the first and second sensors are always supplied at least a second power level, the second power level being lower than the first power level, wherein the first and second sensors detect at least the first power level via a voltage change, and wherein the first and second sensors are connected to a control unit via the line, data transmission during the time between the end of the first time interval and the end of the second time interval only being provided from the sensors to the control unit, and not from the control unit to the sensors.

12. The method according to claim 7, wherein the first and second sensors are always supplied at least a second power level, the second power level being lower than the first power level, and wherein the first and second sensors are connected to a control unit via the line, data transmission during the time between the end of the first time interval and the end of the second time interval only being provided from the sensors to the control unit, and not from the control unit to the sensors.

13. A sensor system comprising:

a first sensor powered by a line, the first sensor preprogrammed with a first time interval for transmitting data via the line;

a second sensor powered by the line in parallel with the first sensor, the second sensor preprogrammed with a second time interval for transmitting data via the line;

a first timing sequence control system included in the first sensor; and a second timing sequence control system included in the second sensor;

wherein, whenever the first sensor detects an increase in the power received from the line to a first power level, the first timing sequence control system is triggered and, upon being triggered, controls the transmission of the first sensor so that the first sensor transmits data via the line for the first time interval, wherein, whenever the second sensor detects an increase in the power received from the line to a first power level, the second timing sequence control system is triggered and, upon being triggered, controls the transmission of the second sensor so that the second sensor transmits data via the line for the second time interval after the first time interval, wherein, upon being triggered, the first and second timing sequence control systems control the transmission of the first and second sensors so that the first and second sensors each transmit data via the line at least once independent of any change in a power level received by the first and second timing sequence control systems, wherein the first and second timing sequence control systems receive the first power level throughout the first and second time intervals and wherein a second power level is constantly supplied from the line to the first and second sensors, wherein the second power level is lower than the first power level, and wherein the second power level ensures that the first and second sensors are constantly in operation.

14. A method for sequential transmission of sensor data, comprising:

powering a first sensor by a line, the first sensor preprogrammed with a first time interval for transmitting data via the line; and powering a second sensor by the line in parallel with the first sensor, the second sensor preprogrammed with a second time interval for transmitting data via the line;

wherein a first timing sequence control system is included within the first sensor and a second timing sequence control system is included within the second sensor, wherein, whenever the first sensor detects an increase in the power received from the line to a first power level, the first timing sequence control system is triggered and, upon being triggered, controls the transmission of the first sensor so that the first sensor transmits data via the line for the first time interval, wherein, whenever the second sensor detects an increase in the power received from the line to a first power level, the second timing sequence control system is triggered and, upon being triggered, controls the transmission of the second sensor so that the second sensor transmits data via the line for the second time interval after the first time interval, wherein, upon being triggered, the first and second timing sequence control systems control the transmission of the first and second sensors so that the first and second sensors each transmit data via the line at least once independent of any change in a power level received by the first and second timing sequence control systems, wherein the first and second timing sequence control systems receive the first power level throughout the first and second time intervals and wherein a second power level is constantly supplied from the line to the first and second sensors, wherein the second power level is lower than the first power level, and wherein the second power level ensures that the first and second sensors are constantly in operation.

* * * * *